US007383669B2

(12) United States Patent
Morse

(10) Patent No.: US 7,383,669 B2
(45) Date of Patent: Jun. 10, 2008

(54) SIDING STARTER STRIP

(75) Inventor: Rick James Morse, Grass Lake, MI (US)

(73) Assignee: CertainTeed Corporation, Valley Forge, PA (US)

( * ) Notice: Subject to any disclaimer, the term of this patent is extended or adjusted under 35 U.S.C. 154(b) by 554 days.

(21) Appl. No.: 10/790,432

(22) Filed: Mar. 1, 2004

(65) Prior Publication Data

US 2005/0229521 A1 Oct. 20, 2005

(51) Int. Cl.
*E04D 1/34* (2006.01)

(52) U.S. Cl. ..... 52/545; 52/58; 52/459; 52/520

(58) Field of Classification Search ..... 52/545, 52/58, 459, 520
See application file for complete search history.

(56) References Cited

U.S. PATENT DOCUMENTS

| | | | | |
|---|---|---|---|---|
| 2,249,125 | A * | 7/1941 | Gabriel | 52/553 |
| 3,173,229 | A * | 3/1965 | Weber | 52/547 |
| 4,054,012 | A | 10/1977 | Paradisi et al. | |
| 4,079,562 | A | 3/1978 | Englert et al. | |
| 4,348,849 | A * | 9/1982 | Wollam et al. | 52/545 |
| 5,575,127 | A * | 11/1996 | O'Neal | 52/520 |
| 5,884,435 | A * | 3/1999 | David et al. | 52/62 |
| 5,916,095 | A | 6/1999 | Tamlyn | |
| 6,367,160 | B1 | 4/2002 | Rempe | |
| 6,408,580 | B1 | 6/2002 | Jurvis et al. | |
| 2003/0056458 | A1 | 3/2003 | Black et al. | |

OTHER PUBLICATIONS

Certainteed, Benefits of Fiber Cement Siding (Beauty), 1 pg. http://www.certainteed.com/cside/csfc00001fu.html, Oct. 21, 2003.
Certainteed, Benefits of Fiber Cement Siding (Durability), 1 pg. http://www.certainteed.com/cside/csfc00002fu.html, Oct. 21, 2003.
Certainteed, CertainTeed WeatherBoards™ FiberCement Siding (Shapes), 1 pg. http://www.weatherboards.com/cside/cswb00101p.html, Oct. 21, 2003.
Certainteed, CertainTeed WeatherBoards™ FiberCement Siding (Lap Siding), 1 pg. http://www.weatherboards.com/cside/cswb00201p.html, Oct. 21, 2003.
Certainteed, CertainTeed WeatherBoards™ FiberCement Siding, Specification Sheet, 2 pp., © Nov. 2002.
PCA Portland Cement Association, Concrete Homes Building Systems, "Fiber-Cement Siding", http://www.concretehomes.com/buildingsystems/fibercementsiding/sys-fibercementsiding . . . , 5 pp., Oct. 21, 2003.
Certainteed, CertainTeed WeatherBoards™ FiberCement Siding (Installation Instructions), 21 pp., © Nov. 2002.
Certainteed, CertainTeed WeatherBoards™ FiberCement Siding , 7 pp., © Nov. 2002.

(Continued)

*Primary Examiner*—Richard E. Chilcot, Jr.
*Assistant Examiner*—Dan Kenny
(74) *Attorney, Agent, or Firm*—Duane Morris LLP

(57) ABSTRACT

A starter strip has a fastener flange, a siding support element connected to the flange, a spacer element connected to the siding support element; and a flashing element connected to the spacer element.

20 Claims, 6 Drawing Sheets

OTHER PUBLICATIONS

Hometime.com, Siding (Fiber-Cement Siding), 3 pp., http://www.hometime.com/Howto/projects/siding/side_ 4.htm, Oct. 21, 2003.

Tamlyn & Sons, Vinyl Lapstart® Starter Strip U.S. Patents #5,916,095, 2 pp., http://www.tamlyn.com/pvc/lapstart.html, Oct. 21, 2003.

Toolbase Services, Path Technology Inventory, (Fiber-Cement Siding), 4 pp., http://www.toolbase.org/tertiary_printT.asp?TRACKID=&CategoryID=1402&DocumentID . . . , Oct. 21, 2003.

* cited by examiner

SIDING STARTER STRIP

FIELD OF THE INVENTION

The present invention relates to siding installation products and methods of installing siding products, and more particularly to starter strips for aiding the installation of lap siding.

BACKGROUND OF THE INVENTION

Fiber-cement siding is increasing in popularity for residential and light commercial applications due to its lower cost and lower maintenance than traditional wood siding. Fiber-cement siding panels are composed of cement, sand and cellulose fibers and generally are manufactured in 5¼ to 12 inch widths and are about 5/15 inches thick. Similarly to wood siding, fiber-cement siding is installed onto a building structure over exterior wall sheathing.

In typical residential building construction, a foundation is laid, and on top of that a sill plate, usually a 2×4, is attached. Wall studs are then framed above the sill plate. Typically, the wall studs are covered with a sheathing, such as plywood, OSB, builder board, foam-type sheathing, or other comparable sheathing materials. On the exterior of the sheathing, a wall covering, such as siding or shingles, is installed to produce a finished appearance. Often the siding is horizontally aligned on the building structure. Where individual siding panels are employed, such as wood panels or the above described fiber-cement siding panels, they are generally installed from the bottom of the building structure upwards in an overlapping manner. In order to properly align the panels on the building structure, a chalk line is snapped to establish a straight reference line. The chalk line guides the positioning of a starter strip, which will in turn guide the vertical position and the angle of the siding panels. Typically, the starter strip is a 1½" inch wide and ¼" to 5/16" thick strip of fiber cement, wood, or vinyl, which is positioned towards the bottom of the sheathing so that the bottom edge of the lowermost siding panel will project at least ⅛" below the bottom edge of the starter strip when installed on the building structure.

Often the sill plate and sheathing are exposed to moisture and insects around the area of the foundation. This is because water draining downwardly from the siding panels, water from blowing rain, and water splashing upwardly from the ground can come into contact with exposed regions of the sheathing and sill plate behind the lowermost siding panel and starter strip. This exposure to moisture and insects may cause rotting or other undesirable structural damage to the sheathing and sill plate.

U.S. Pat. No. 5,916,095 to Tamlyn discloses starter strips designed to reduce exposure of the sill plate and/or sheathing panel to water. In one embodiment, the starter strip includes a bottom face which extends below the sill plate to protect the exposed sill plate from moisture. The starter strip also includes an angle face which is used as a pedestal to define the angular offset of the lowermost siding panel. In a second embodiment, the starter strip includes a back plate, a face plate normal to the back plate, and an angled remaining face. Upon installation of this starter strip, the back plate extends above and below the sill plate to protect the sill plate from moisture. The face plate covers the bottom edge of the sheathing panel to protect the bottom edge of the sheathing panel from exposure to moisture. The angled remaining face provides cosmetic trim. The first embodiment does not adequately set the proper vertical starting location for the lowermost siding panel, and the second embodiment is not employed in the installation of siding panels, but rather is employed for the protection of the sheathing panel and sill plate.

What is needed is an improved starter strip for the installation of siding panels.

SUMMARY OF THE INVENTION

The present invention comprises a starter strip having a fastener flange, a siding support element connected to the flange, a spacer element connected to the siding support element; and a flashing element connected to the spacer element.

According to another aspect of the invention, a building system includes a building structure and a starter strip. The building structure includes a foundation, a sill plate installed on and substantially even with the foundation, wall studs attached to and substantially even with the sill plate, and a sheathing attached to an outside surface of the wall studs and sill plate and having a bottom edge which terminates at the bottom edge of the sill plate. The starter strip includes a fastener flange, a siding support element connected to the flange, a spacer element connected to the siding support element, and a flashing element having a horizontal member and being connected to the spacer element. The horizontal member of the flashing element is flush against the bottom edge of the sheathing and terminates at a top edge of the foundation.

According to a further embodiment, a building system includes a building structure and a starter strip. The building structure includes a foundation, a sill plate installed on the foundation, wall studs attached to and substantially even with the sill plate, and a sheathing attached to an outside surface of the wall studs and sill plate and having an outside surface which is even with an outside surface of the foundation. The starter strip includes a fastener flange, a siding support element connected to the flange, a spacer element connected to the siding support element, and a flashing element having a horizontal member and being connected to the spacer element. The horizontal member of the flashing element terminates at a top edge of the foundation.

According to another embodiment, a method of installing a lap siding panel includes providing a building structure and a starter strip, abutting the horizontal member of the flashing element of the starter strip against the bottom edge of the sheathing, and fastening the starter strip to the sheathing. The building structure has a foundation, a sill plate installed on and substantially even with the foundation, wall studs attached to and substantially even with the sill plate, and a sheathing attached to an outside surface of the wall studs and sill plate and having a bottom edge which terminates at the bottom edge of the sill plate. The starter strip includes a fastener flange, a siding support element connected to the flange, a spacer element connected to the siding support element, and a flashing element having a horizontal member and being connected to the spacer element.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
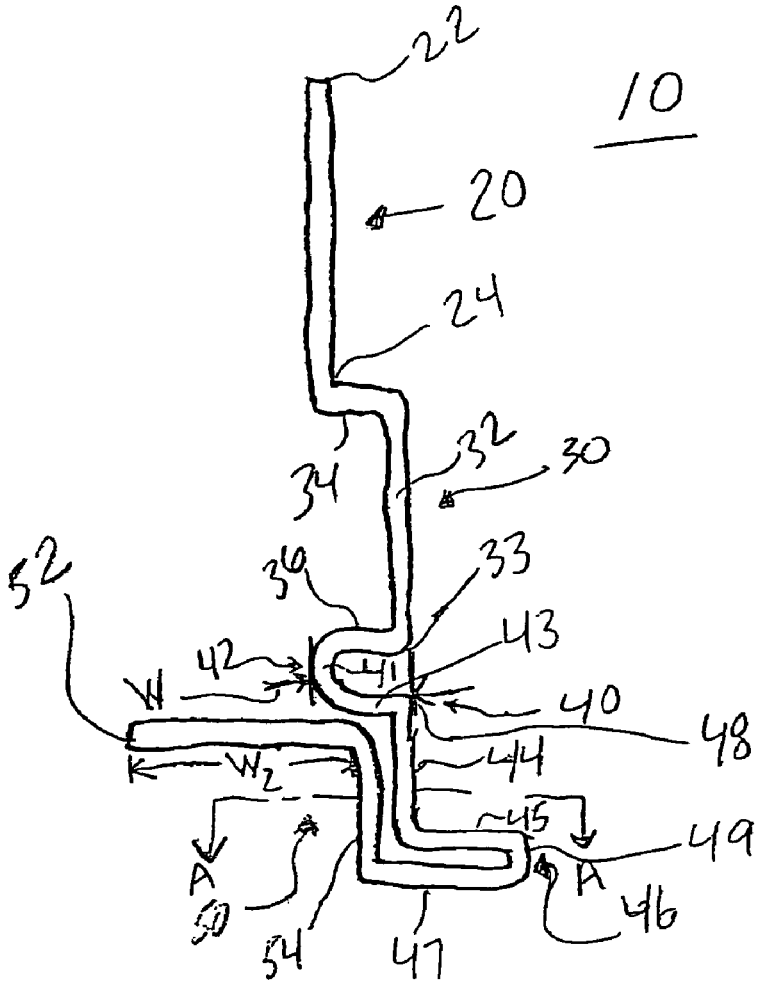
FIG. 1 is a side cross-sectional view of an exemplary starter strip.
Figure 2:
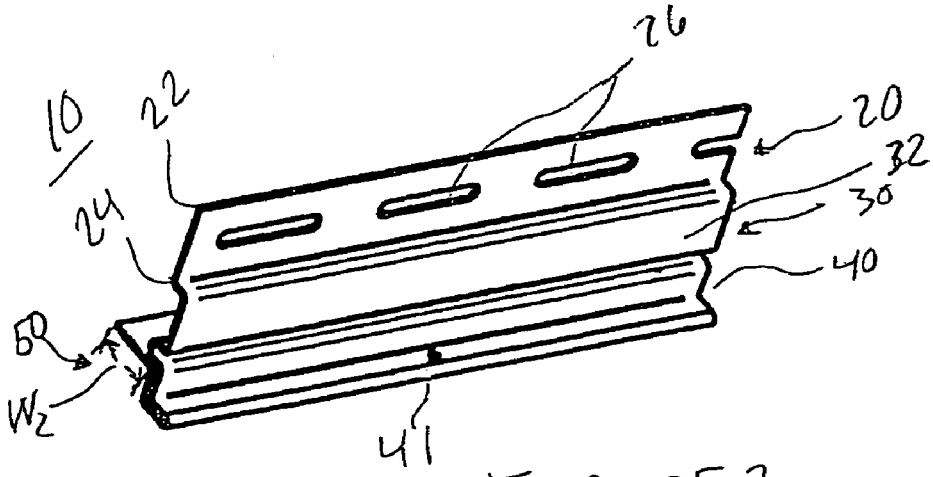
FIG. 2 is an isometric view of the starter strip of FIG. 1.
Figure 3:
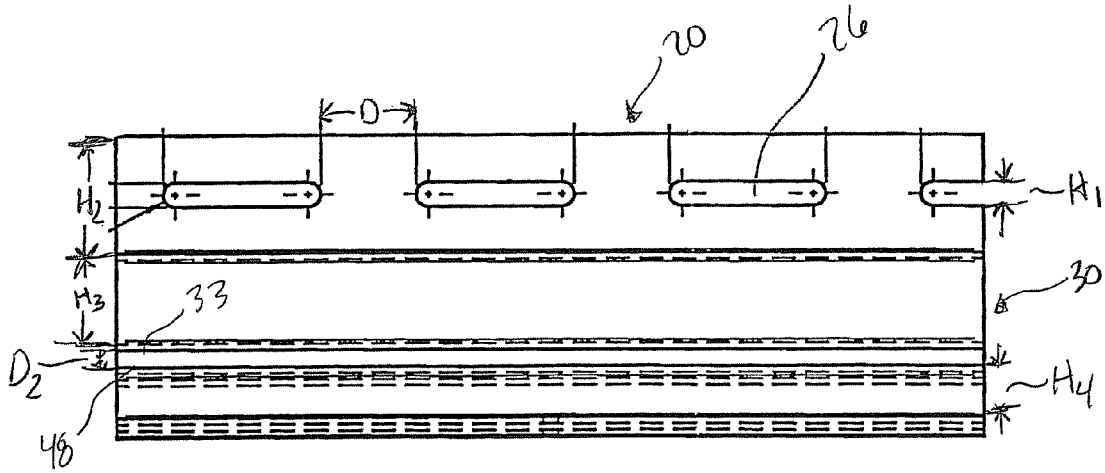
FIG. 3 is front view of the starter strip of FIG. 1.
Figure 4:
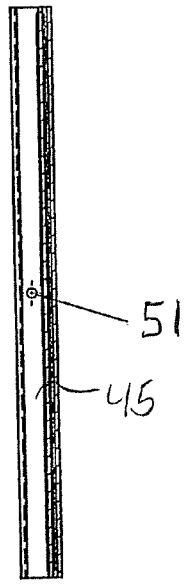
FIG. 4 is a cross-section view taken along line A-A of FIG. 1.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Referring to FIG. 1, an exemplary embodiment of a starter strip 10 is shown for aiding in the installation of siding panels. The starter strip 10 may be employed with a variety of different siding types, but is especially preferred for use in installing fiber cement siding. Typically, although not limited thereto, the starter strip 10 will be attached to the external vertical wall of a building structure as a guide for the installation of the first siding panel. The starter strip 10 includes a fastening element or flange 20, a siding support element 30, a spacer element 40 and a flashing element 50. The starter strip 10 may be comprised of a plastic material, a metal, or a composite material, for example. Where the starter strip is formed of a plastic material, preferably it is an extruded plastic material, such as extruded polyvinylchloride, for example. Where the starter strip is comprised of metal, such as aluminum, for example, preferably the strip is folded into its desired shape.

The starter strip 10 may be formed in a variety of lengths, such as standard lengths for lap siding, which can be easily shipped and handled. The starter strip 10 may also be manufactured in twelve inch lengths, which may be installed intermittently along a wall of a building structure. The starter strip 10 may be cut to any desired length, such as the length of the wall on which the siding is being installed. The thickness of the starter strip 10 may vary depending on the material from which it is formed. Where the starter strip is comprised of polyvinyl chloride, preferably the strip is approximately between about 0.003 to 0.05 inch in thickness. The starter strip may also be colored, for example, to match the coloring of the corresponding siding panels.

The fastening flange 20 of starter strip 10 is a substantially planar elongated member which is located at the top of the starter strip 10 when the strip is attached to a sheathing 95 of the building structure 70. The exemplary fastening flange 20 includes a first end 22 and a second end 24 and a plurality of elongated slots 26 for insertion of fasteners, such as nails or screws which attach the flange 20 to the sheathing 95 or other building material. The elongated slots 26 are preferably approximately one inch in width. The width of the elongated slots 26 allows for expansion or contraction of the strip 10 in the direction of elongation. The distance D between the elongated slots 26 is preferably between about 0.3 to 0.9 inch, and more preferably about 0.6 inch. The height H1 of the elongated slots 26 are preferably between about 0.1 and 0.2 inch, and more preferably approximately 0.15 inch. The height H2 of the flange 20 may be any height sufficient for facilitating attachment of the starter strip 10 to the building structure 70. Preferably, the height H2 is approximately three quarters of an inch.

The exemplary siding support element 30 includes a front face 32 and a first and second horizontal member 34, 36. The first and second horizontal members are substantially parallel to one another and are preferably substantially at right angles to the flange 20. The first horizontal member is connected to the second end 24 of the flange 20. The front face 32, which is connected to the first and second horizontal members 34, 36, is at an angle away from vertical as defined by the spacer element 40 described below. The support element 30 provides a backing or support for the siding so that the siding can be face nailed without the nail breaking out the back of the siding panel. The height H3 of the front face 32 may be any height sufficient to support the siding for nailing, but is preferably approximately one half inch in height.

The spacer element 40 provides the desired angle or slope for the first siding panel 60, which in turn provides the proper angle or slope for subsequent siding panels, which are installed in an overlapping manner. The spacer element 40 also cooperates with the flashing element 50 to provide the proper starting position on the wall without the need for measurement by an installer. The exemplary spacer element 40 includes a spacing component 42, an angle component 44, and a bottom component 46. The spacing component preferably comprises a connecting piece 41 and spacer piece 43. The connecting piece 41 connects the second horizontal member 36 of the siding support element 30 and the spacer piece 43. The connecting piece 41 preferably lies against the sheathing 95, or other building material, and, in conjunction with the second horizontal member 36 and spacer piece 43, provides support for the siding panel 60 when the siding panel is being face nailed to the sheathing 95. The width W of the spacer piece 43 and slope of the angle component 44 determines the angle θ away from vertical of the siding panel 60 when the siding panel is installed on the starter strip 10. Preferably the width W of the spacer piece is approximately between about one quarter to one half inch and the angle θ is approximately between about 1° to 5°, and more preferably about 3°. The height H3 of the angle component 44 is preferably between about one eighth to one-half inch, and more preferably approximately one quarter inch. The distance D2 between a top edge 48 of the angle component 44 and a bottom edge 33 of the front face 32 of the support element 30 is preferably between about 0.1 and 0.25 inch, and more preferably approximately 0.188 inch.

Figure 9:
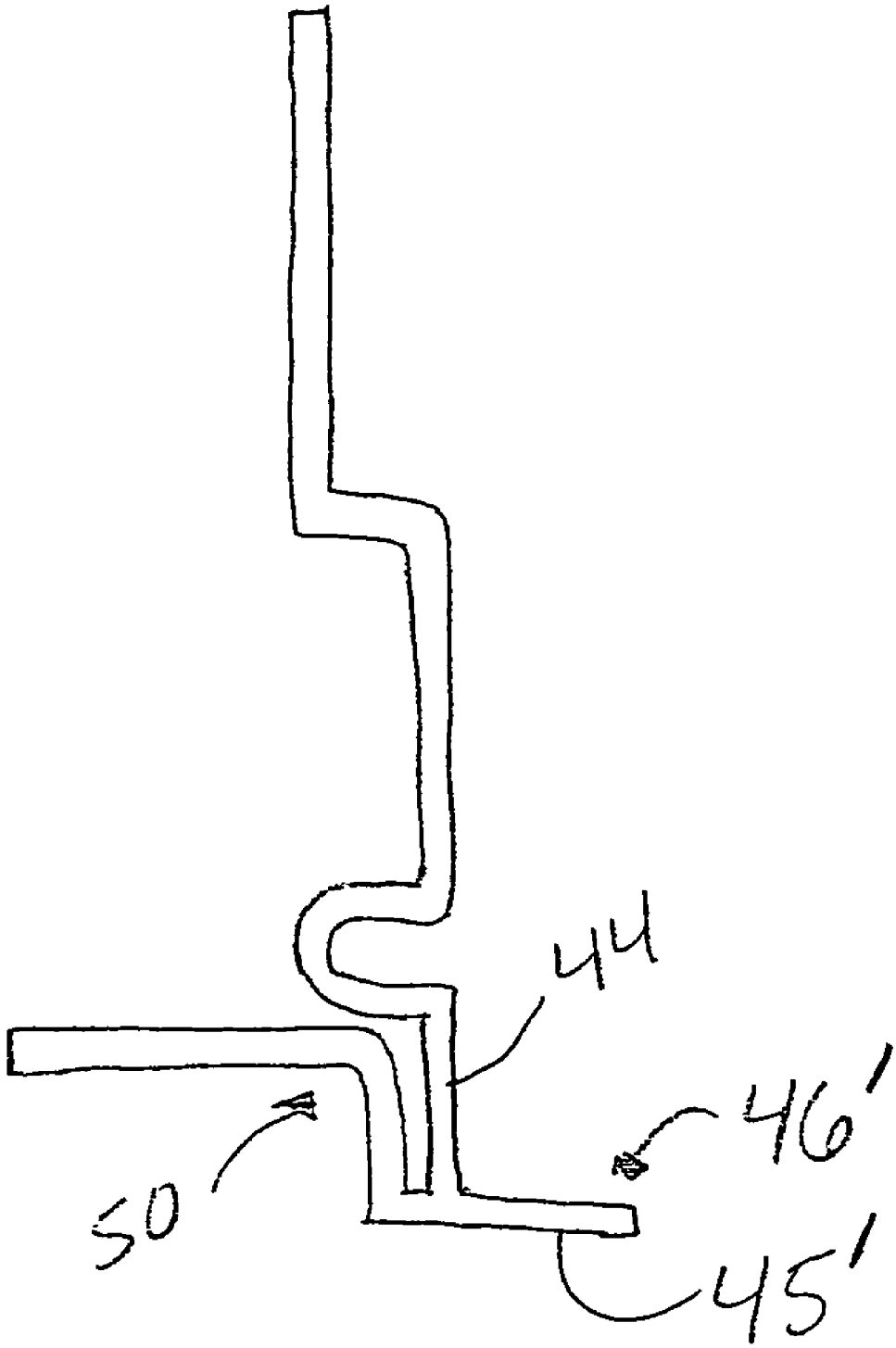
FIG. 9 is a side cross-sectional view of another exemplary starter strip.

The bottom component 46 is preferably substantially U-shaped, as shown, and preferably includes a first and second horizontal component 45, 47 and a connecting piece 48. (Alternatively, the bottom component 46' can have the profile exemplified in FIG. 9, wherein the bottom component 46' has only one horizontal component 45' which is connected to the angle component 44 and the flashing element 50.) The bottom component 46 aids in positioning the siding panel 60, as the siding panel is preferably installed with the panel's bottom surface 64 flush against the first horizontal component 45. The first horizontal component acts as a support for the siding panel. The first and second horizontal components 45 (or 45'), 47 of the bottom component 46 (or 46') also preferably includes at least one drain opening 51 for facilitating the drainage of water that runs down the siding panel 60. Preferably these drainage openings 51 are approximately 3/32 in diameter and are positioned approximately every six inches along the length of the first and second horizontal components.

The flashing element 50 includes a horizontal member 52 and a vertical member 54. Preferably the flashing element 50 is substantially L-shaped, as shown, with the horizontal member 52 and vertical member 54 at substantially a right angle. The horizontal member 52 preferably has a width $W_2$ that is at least the thickness of a typical sheathing, i.e., 5/16", 3/8", 7/16", 15/32", 19/32", or 1/2". The starter strip 10 can be formed with horizontal members 52 of various widths to correspond to the thickness of the sheathing material being employed. The flashing element 50 aids not only in the positioning of the siding panels, but also helps to protect the sheathing 95 and sill plate 85 from damage due to moisture and insects. When the starter strip 10 is installed, the horizontal member 52 will lie substantially flush against the bottom surface 96 of the sheathing 95. This positioning of the horizontal member 52 under the sheathing 95 sets the vertical placement of the lowermost siding panel at the desired location on the building structure 70. This location preferably places the bottom surface 64 of the siding panel 60 about one quarter of an inch below the sill plate 85 and sheathing 95. Preferably the horizontal member 52 is positioned with its bottom face 56 completely below the sill plate 85. This will aid in preventing water from splashing onto the sill plate and rotting or otherwise damaging the sill plate, in addition to the sheathing 95. It will also prevent insects from obtaining access to the sill plate and sheathing.

Figure 5:
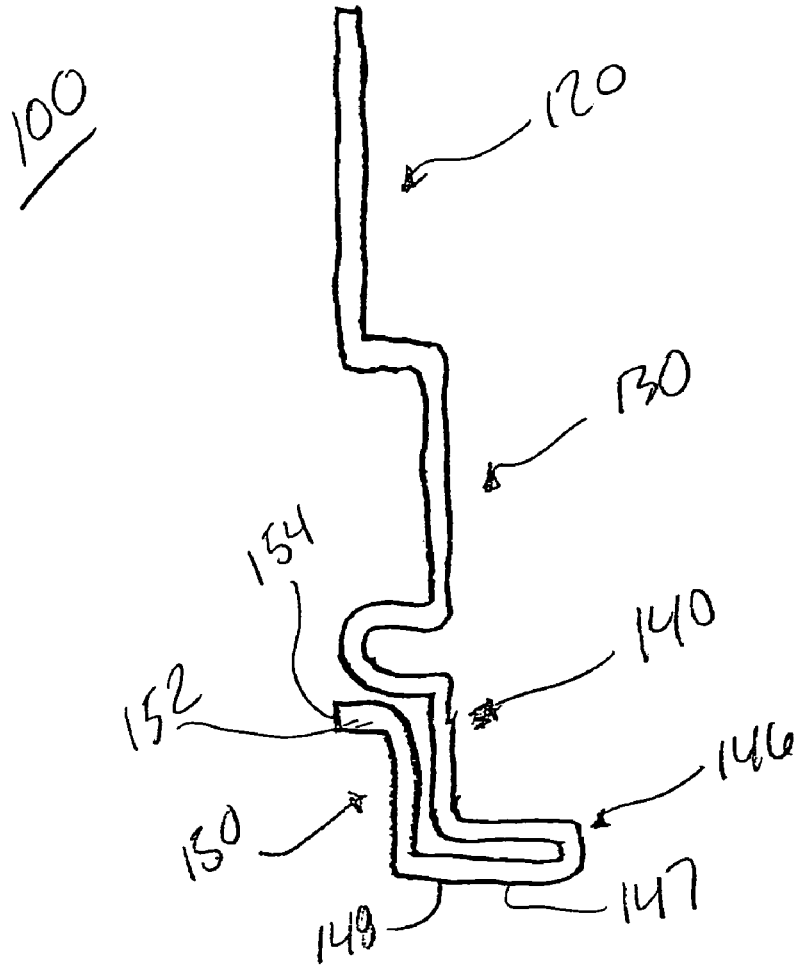
FIG. 5 is a side cross-sectional view of another exemplary starter strip.
Figure 6:
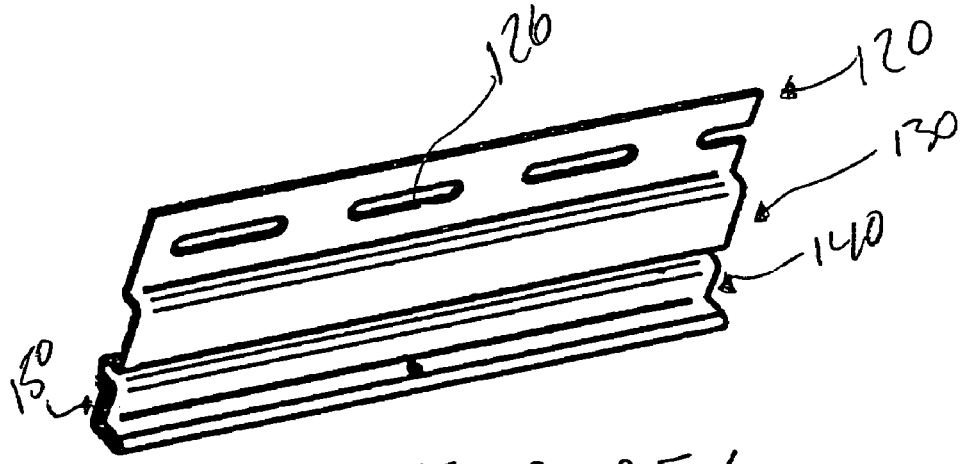
FIG. 6 is an isometric view of the starter strip of FIG. 5.
Figure 8:
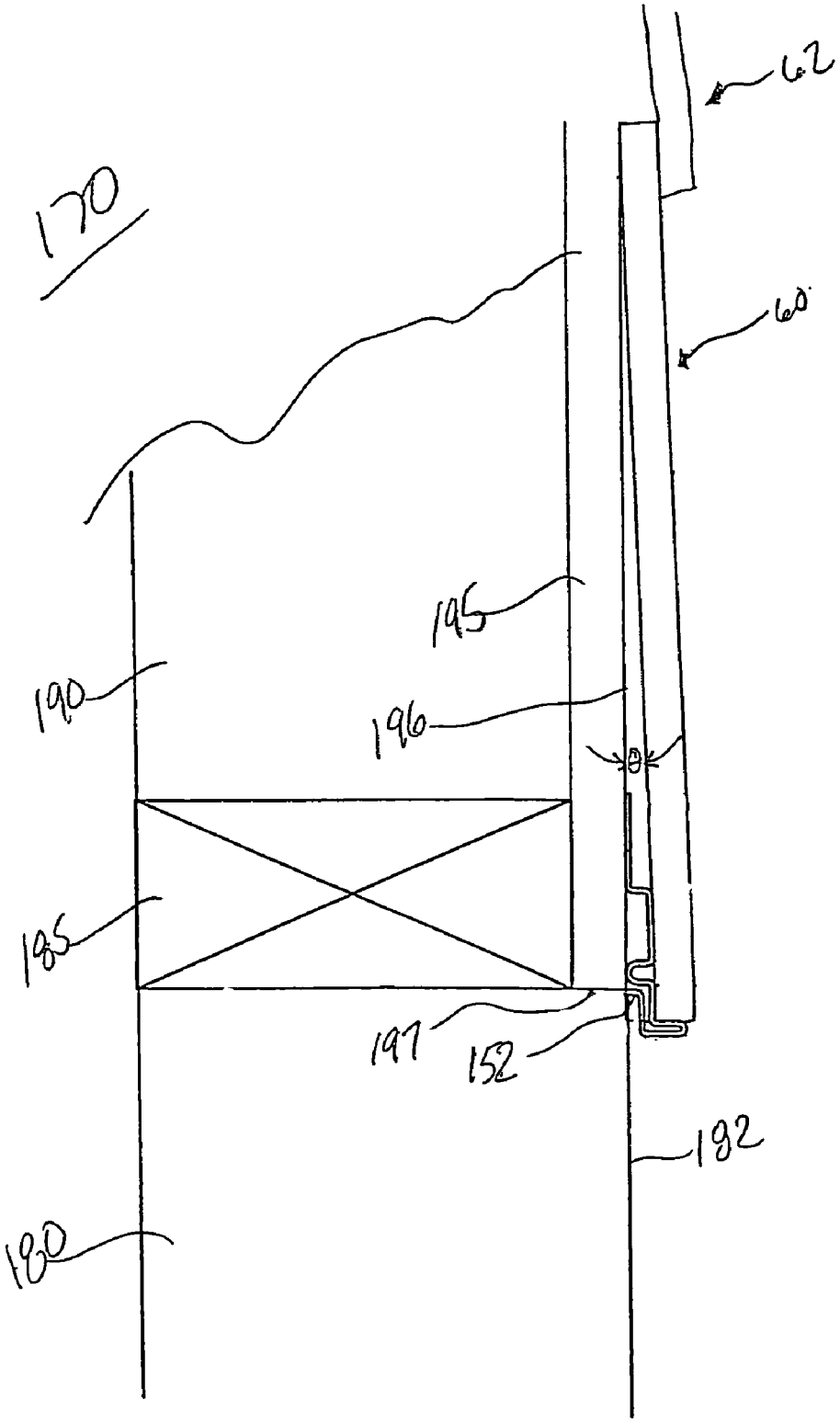
FIG. 8 is a partial side cross-sectional view of a building system employing the starter strip of FIG. 5.

Referring to FIG. 5-6 and 8, another exemplary embodiment of a starter strip 100 is shown which is beneficially used in conditions where an outer surface 196 of the sheathing 195 is flush with an outer surface 182 of the foundation 180 (see FIG. 8). Starter strip 100 includes a fastening element or flange 120, a siding support element 130, a spacer element 140, and a flashing element 150. Starter strip 100 is similar to starter strip 10, with the exception that the flashing element 150 of starter strip 100 includes an abbreviated horizontal member 152 having an edge 154 that is even with the plane of the fastening element 120. In this embodiment, the horizontal member 152 is beneath the plane of the bottom edge 197 of the sheathing 195. As described above with respect to starter strip 10, this will set the vertical placement of the lowermost siding panel at the desired location on the building structure, will aid in preventing water from splashing onto the sheathing and rotting or otherwise damaging the sheathing 195, and will also prevent insects from obtaining access to the sheathing.

Figure 7:
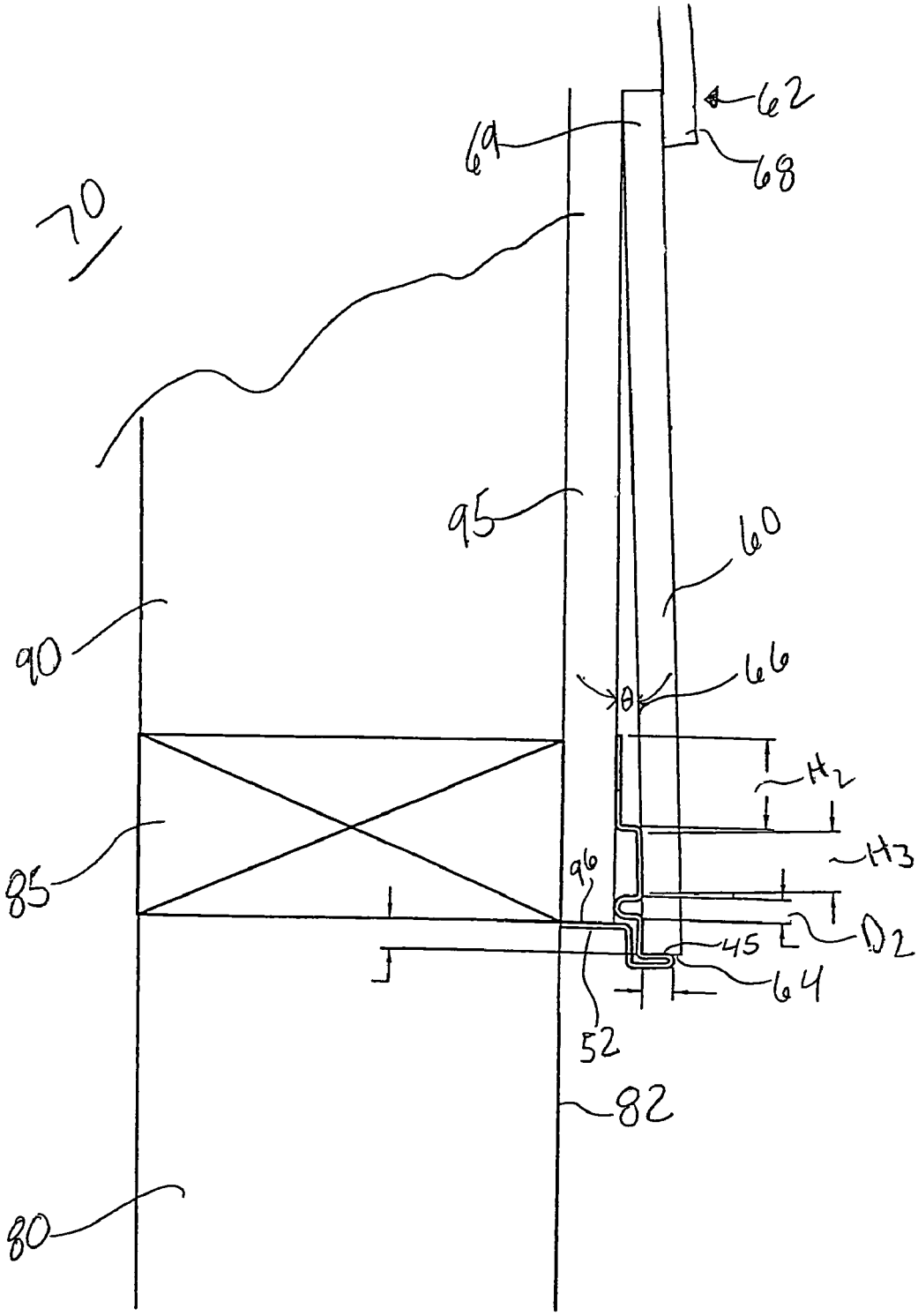
FIG. 7 is a partial side cross-sectional view of a building system employing the starter strip of FIG. 1.

Referring now to FIG. 7, a partial building structure 70 is shown on which starter strip 10 and siding panels 60, 62, preferably fiber cement lap siding panels, have been installed. Building structure 70 includes a foundation 80, a sill plate 85, wall studs 90, and sheathing 95. Typically, the face 82 of the foundation 80 is exposed from the ground from about 2 to 12 inches. A sill plate 85, which is usually a 2×4, is attached to the foundation. Wall studs 90 are installed above the sill plate 85 and sheathing 95 is attached to the wall studs 90. The starter strip 10 is then installed according to the following procedure.

The horizontal member 52 of the flashing element 50 is placed flush against the bottom surface 96 of the sheathing 95. Fasteners, such as nails or screws (not shown), are inserted through some elongated slots 26 and into the sheathing 95 to attach the starter strip 10 to the building structure 70. A first lowermost siding panel 60 is installed onto the starter strip 10. It is placed so that the bottom edge 64 of the first siding panel 60 is against the first horizontal component 45 of the bottom component 46 of the spacer element 40. This locates the bottom edge 64 of the siding panel approximately one-quarter of an inch below the sill plate 85. The first siding panel 60 may then be face nailed through the siding panel 60 and front face 32 of the siding support element 30, which aids in preventing the back 66 of the siding panel 60 from being broken out in the nailing process. Once the first siding panel 60 has been positioned at the desired vertical position and angle via the starter strip 10, a second siding panel 62 can be installed by overlapping a bottom 68 of the second siding panel 60 over a top 69 of the first siding panel 60 and attaching the second siding panel 62 to the building structure. Preferably, the overlap is between about one to one and one-half inches, and more preferably about one and one-quarter inches. The first and second siding panels 60, 62 and subsequently installed siding panels may be either blind nailed or face nailed, as desired, to the building structure 70.

Referring to FIG. 8, a partial building structure 170 is shown on which starter strip 100 and siding panels 60, 62, preferably lap siding panels, have been installed. Building structure 170 includes a foundation 180, a sill plate 185, wall studs 190, and sheathing 195. Unlike building structure 70, building structure 170 includes a sheathing 195 that has an outside surface 196 which is flush with an outside surface 182 of the foundation 180. The sheathing material is preferably plywood or OSB, although builder board and foam-type sheathing materials are also acceptable. The starter strip 100 is installed by placing the horizontal member 152 of the flashing element 150 beneath the plane of the bottom edge 197 of the sheathing 195 and inserting fasteners through the elongated slots 126 of the fastening element 120. This sets the vertical placement of the lowermost siding panel 60 at the desired location on the building structure, preferably approximately one-quarter inch below the sheathing 195 and sill plate 185, and provides the sheathing and sill plate with protection from moisture and insects. A first lowermost siding panel 60 and subsequent panels 62 are installed as described above with respect to building structure 70 and starter strip 10.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A starter strip comprising:

a fastener flange;

a siding support element connected to the flange, wherein the siding support element includes a front face;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece;

wherein the front face of the siding support element and the angle component of the spacer element are inclined at an equal angle away from vertical; and a flashing element connected to the spacer element.

2. The starter strip of claim 1, wherein the starter strip is comprised of a folded metal.

3. The starter strip of claim 1, wherein the angle is 3 degrees.

4. A starter strip comprising:

a fastener flange;

a siding support element connected to the fastener flange, wherein the siding support element further includes a first and a second horizontal member which are substantially perpendicular to the fastener flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece; and a flashing element connected to the spacer element, wherein the starter strip is comprised of a folded metal.

5. A starter strip comprising:

a fastener flange;

a siding support element connected to the flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece, wherein the bottom component is substantially U-shaped; and a flashing element connected to the spacer element.

6. The starter strip of claim 5, wherein the starter strip is comprised of an extruded plastic material.

7. The starter strip of claim 5, wherein the first and second horizontal components include at least one drain opening.

8. The starter strip of claim 5, wherein the first horizontal component of the bottom component is approximately one-quarter inch below a horizontal member of the flashing element when the starter strip is oriented in an installed position.

9. The building system of claim 5, further including a siding panel, wherein a bottom edge of the siding panel abuts a bottom component of the spacer element.

10. A starter strip comprising:

a fastener flange;

a siding support element connected to the flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece; and a flashing element connected to the spacer element, wherein the flashing element includes a horizontal member and a vertical member.

11. The starter strip of claim 10, wherein an end of the horizontal member terminates at a point even with the plane of the fastener flange.

12. The starter strip of claim 10, wherein an end of the horizontal member extends beyond the plane of the fastener flange.

13. The starter strip of claim 12, wherein the width of the horizontal member corresponds substantially to the width of a sheathing material.

14. A building system comprising:

a starter strip comprising:

a fastener flange;

a siding support element connected to the flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece; and p2 a flashing element connected to the spacer element, and further comprising:

a building structure comprising a foundation, a sill plate installed on and substantially even with the foundation, wall studs attached to and substantially even with the sill plate, and a sheathing attached to an outside surface of the wall studs and sill plate and having a bottom edge which terminates at the bottom edge of the sill plate;

wherein the flashing element has a horizontal member that is flush against the bottom edge of the sheathing and terminates at a top edge of the foundation.

15. The building system of claim 14, further including a siding panel, wherein a bottom edge of the siding panel abuts a bottom component of the spacer element.

16. The building system of claim 15, wherein the siding panel is a fiber cement lap siding panel.

17. A building system including:

a starter strip comprising:

a fastener flange;

a siding support element connected to the flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece; and a flashing element connected to the spacer element, the building system further comprising:

a building structure comprising a foundation, a sill plate installed on the foundation, wall studs attached to and substantially even with the sill plate, and a sheathing attached to an outside surface of the wall studs and sill plate and having an outside surface which is even with an outside surface of the foundation;

wherein the flashing element has a horizontal member that terminates at a top edge of the foundation.

18. A method of installing a lap siding panel, comprising the steps of:

providing a starter strip comprising:

a fastener flange;

a siding support element connected to the flange;

a spacer element connected to the siding support element, wherein the spacer element includes:

a spacing component connected to the siding support element, an angle component connected to the spacing component, and a bottom component connected to the angle component, the bottom component including a first and second horizontal component and a connecting piece; and a flashing element connected to the spacer element;

providing a building structure having a foundation, a sill plate installed on and substantially even with the foundation, wall studs attached to and substantially even with the sill plate, and a sheathing attached to an outside surface of the wall studs and sill plate and having a bottom edge which terminates at the bottom edge of the sill plate;

abutting a horizontal member of the flashing element of the starter strip against the bottom edge of the sheathing, and fastening the starter strip to the sheathing.

19. The method of claim 18, further comprising installing a siding panel on the starter strip by abutting a bottom edge of the siding panel and a bottom component of the spacer element.

20. The method of claim 19, wherein the step of installing the siding panel further includes nailing the siding panel through the siding support element of the starter strip and into the sheathing of the building structure.

* * * * *

UNITED STATES PATENT AND TRADEMARK OFFICE

CERTIFICATE OF CORRECTION

PATENT NO. : 7,383,669 B2
APPLICATION NO. : 10/790432
DATED : June 10, 2008
INVENTOR(S) : Rick James Morse It is certified that error appears in the above-identified patent and that said Letters Patent is hereby corrected as shown below:

Column 8, line 34, delete “p2”.

Signed and Sealed this

Twelfth Day of August, 2008

JON W. DUDAS
*Director of the United States Patent and Trademark Office*